US007742363B2

(12) United States Patent
Gruosi et al.

(10) Patent No.: US 7,742,363 B2
(45) Date of Patent: Jun. 22, 2010

(54) MECHANICAL DIGITAL DISPLAY

(75) Inventors: Fawaz Gruosi, Prangins (CH); Jean-François Mojon, Hauts-Geneveys (CH)

(73) Assignee: De Grisogono SA (CH)

( * ) Notice: Subject to any disclaimer, the term of this patent is extended or adjusted under 35 U.S.C. 154(b) by 316 days.

(21) Appl. No.: 11/856,881

(22) Filed: Sep. 18, 2007

(65) Prior Publication Data

US 2008/0295370 A1 Dec. 4, 2008

(30) Foreign Application Priority Data

Sep. 28, 2006 (EP) ..... 06020372

(51) Int. Cl.
*G04B 19/00* (2006.01)
*G04B 19/20* (2006.01)
*G09F 3/04* (2006.01)

(52) U.S. Cl. ..... 368/76; 368/78; 368/220; 40/450

(58) Field of Classification Search ..... 368/76, 368/78, 220, 222, 235; 40/450, 451
See application file for complete search history.

(56) References Cited

U.S. PATENT DOCUMENTS 3,683,523 A * 8/1972 Boyles ..... 40/451
3,965,668 A * 6/1976 Tomokazu et al. ..... 368/227
4,017,154 A * 4/1977 Kobayashi ..... 359/238
4,024,532 A * 5/1977 Sherwin ..... 345/110
4,152,853 A * 5/1979 Lewis ..... 40/451
4,193,256 A * 3/1980 Tobeta et al. ..... 368/74
4,860,471 A * 8/1989 Bonanomi ..... 40/450
5,315,775 A * 5/1994 Parker et al. ..... 40/450
5,388,356 A * 2/1995 Kalivas ..... 40/450
6,625,911 B2 * 9/2003 Kim ..... 40/450

FOREIGN PATENT DOCUMENTS

CH 568 600 3/1975
FR 2543337 9/1984

* cited by examiner

*Primary Examiner*—Vit W Miska
(74) *Attorney, Agent, or Firm*—Galbreath Law Offices, P.C.; John A. Galbreath

(57) ABSTRACT

Mechanical digital display including at least one digit consisting of at least seven segments (1) for the display of alphanumeric characters. Each segment (1) is a body in the form of a bar (1) which can pivot about its longitudinal shaft (3), the said bars (1) having at least two areas resembling a first and a second strip (1', 1"). These have different appearances, and are arranged along the length of the bar (1) in such a way that the orientation of the bar (1) by rotation about its longitudinal shaft (3) enables either the first or the second strip (1', 1") to be made visible. The display of an alphanumeric character is achieved as a result of the dissimilarity of the appearance between the first and second strip (1', 1") of the set of bars (1). The pivoting of one or more bars (1) to replace the first strip (1') with the second strip (1") or vice versa generates the display of different alphanumeric characters. At least one pinion (2), fixed to the bar (1), is positioned around each longitudinal shaft (3) adjacent to at least one of the ends of said bar (1). The bars (1) are pivoted by means of cams (4) interacting directly or indirectly with each pinion (2).

7 Claims, 6 Drawing Sheets

MECHANICAL DIGITAL DISPLAY

Figure 1:
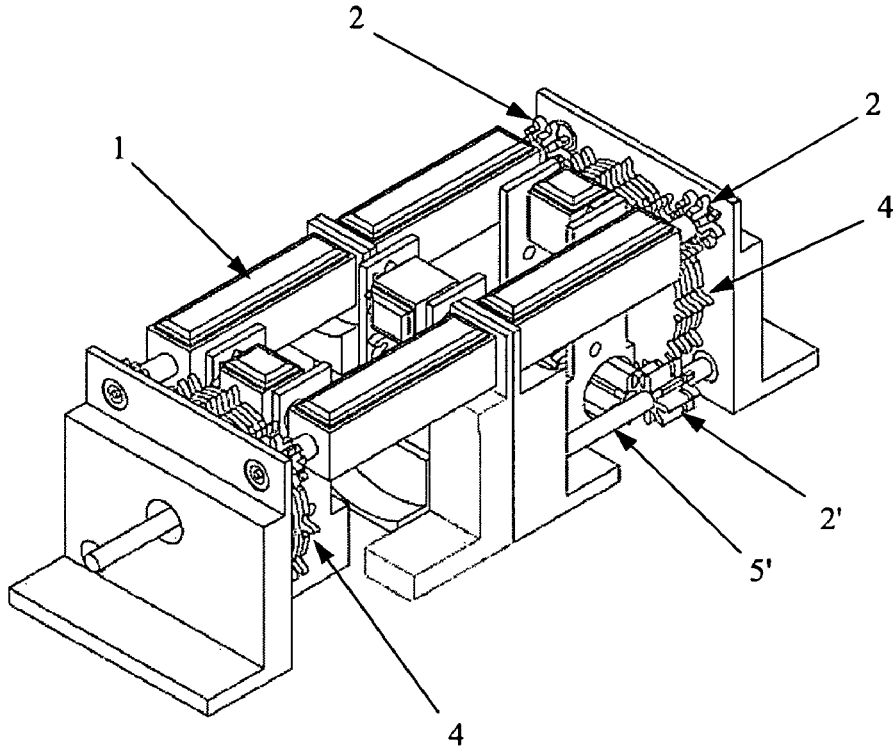

The present invention relates to mechanical digital displays, and more specifically to an operating device which can transmit a movement to a mechanical digital display incorporated into a wristwatch.

Most digital display wristwatches usually include elements such as light-emitting diodes having electro-optical properties, placed in a rigid display panel and connected to an electronic circuit in such a way that the desired time indication is obtained by the excitation of certain segments of each of the sets forming the geometric figures from which the time indication is produced.

However, digital displays for wristwatches made in a wholly mechanical form are known in the prior art. CH 568600 describes a mechanism whose segments are formed by the deposition of tritium on the watch dial. Said segments can be masked by plates positioned on yokes in the form of bent levers. These levers are operated by cams which are driven by a watch movement. The pivoting of the bent yokes displaces the plates parallel to themselves in such a way that they cover the appropriate segments. A mention is made of the possibility of depositing the tritium directly onto the yokes, which could be bodies of revolution. These bodies of revolution appear partly in the slits of the dial and are driven by cams.

Other partially mechanical digital display devices are in use in similar fields such as the indication of speed or temperature measurements. FR 2 543 337 discloses such a device having display elements in the form of elongate prisms. These serve as segments making up a digit and can pivot on their respective longitudinal axes. Each face of the prism has a colour contrasting with those of the adjacent faces, so that the display of a digit is produced by the dissimilarity of the colours visible through slits formed in a casing, the visible colour being determined by the orientation of the prism about its longitudinal axis.

Each prism is rotated by a motor, and thus seven separate motors are required to drive the seven segments of a digit. This type of drive is therefore relatively bulky and can only be installed in display systems of a large size.

The object of the present invention is to propose a mechanical digital display having a drive device for rotating the display elements which is compact, so that it can be incorporated in a wristwatch, for example.

According to the invention, this object is achieved by means of a mechanical digital display as claimed in claim 1. This mechanical display includes at least one digit consisting of at least seven segments for the display of alphanumeric characters. Each segment is an elongate body in the form of a bar which can pivot about its longitudinal shaft, each of the said bars having at least two areas resembling a first and a second strip. These have different appearances, and are arranged along the length of the bar in such a way that the orientation of the bar by rotation about its longitudinal shaft enables either the first or the second strip to be made visible. The display of an alphanumeric character is achieved by the dissimilarity of the appearance between the first and second strip of the set of bars. The pivoting of one or more bars to replace the first strip with the second strip or vice versa creates the display of different alphanumeric characters. At least one pinion, fixed to the bar, is positioned around each longitudinal shaft adjacent to at least one of the ends of said bar. The bars are pivoted by means of cams interacting directly or indirectly with each pinion.

Figure 2:
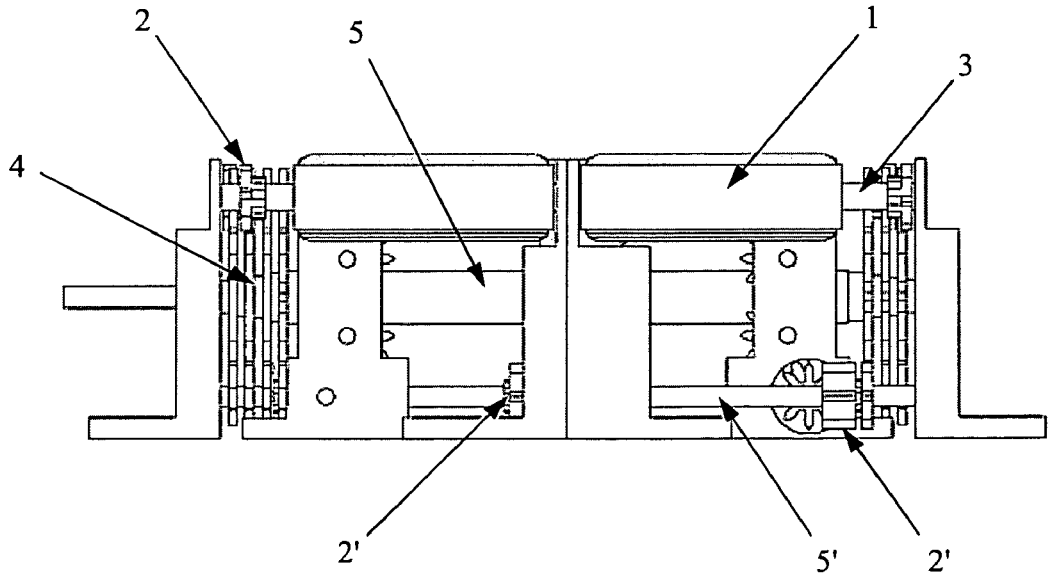
Figure 3:
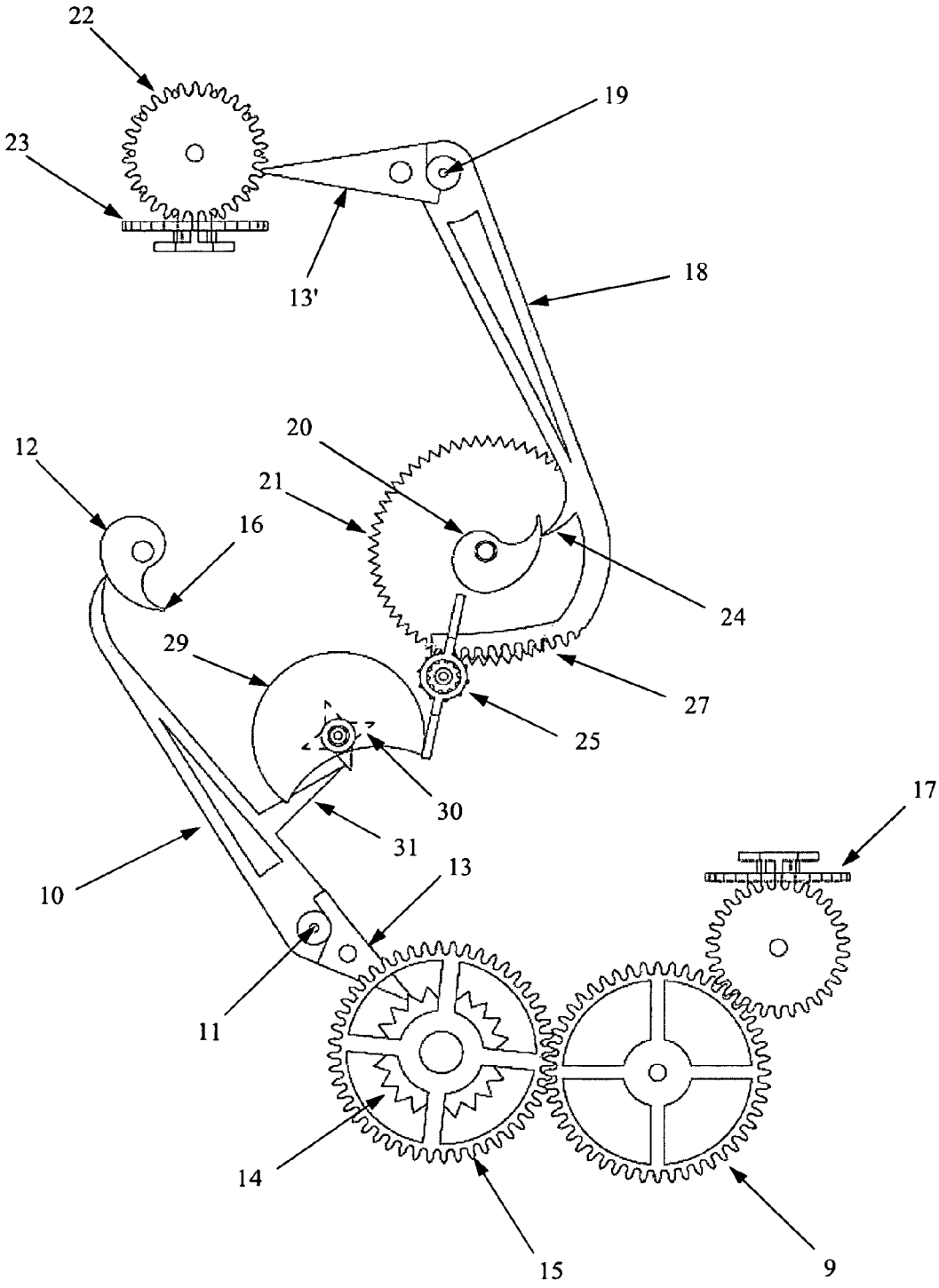
Figure 4:
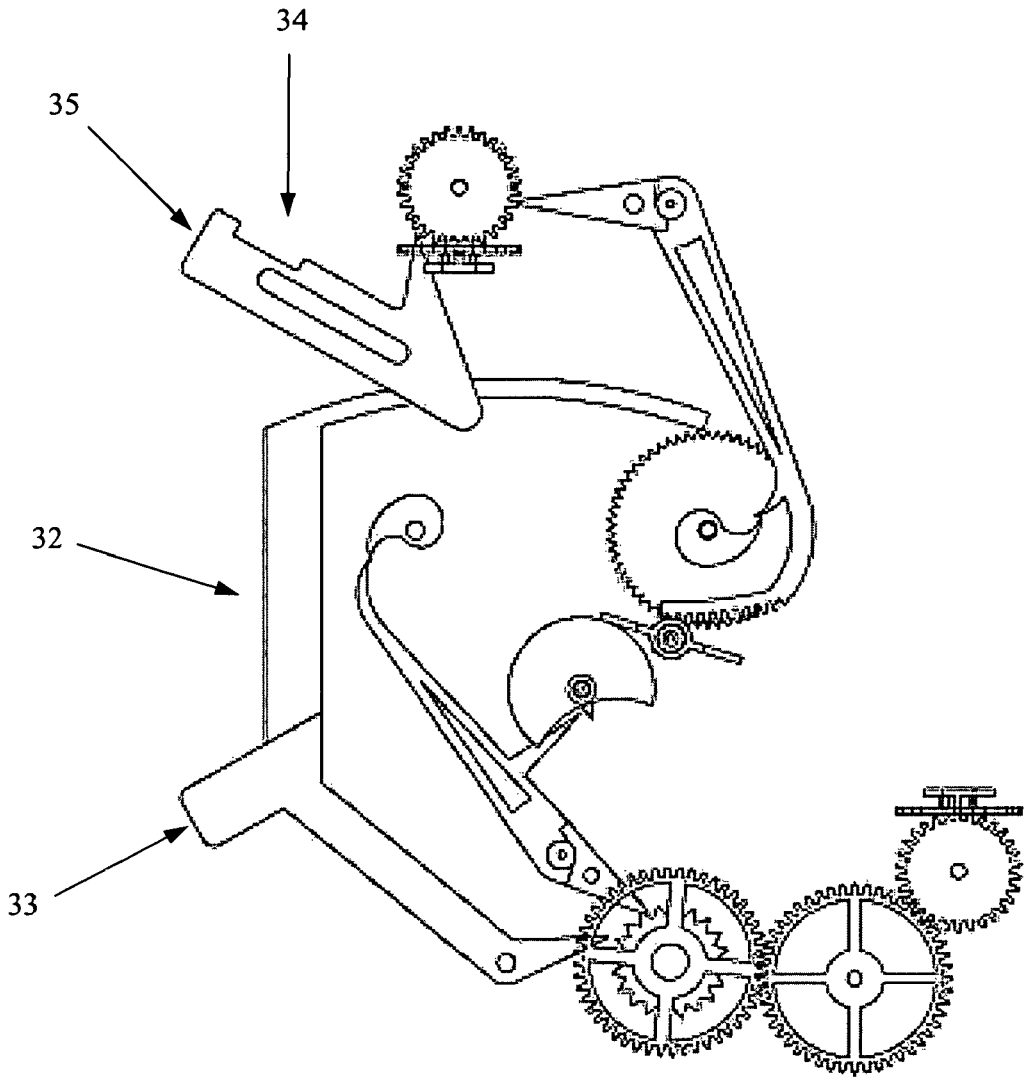
Figure 5:
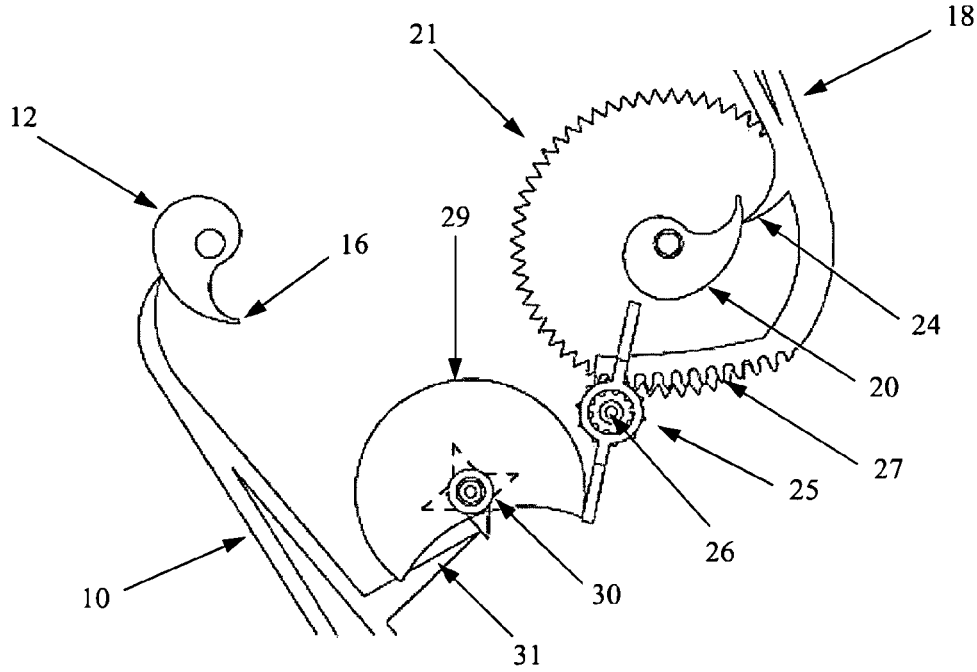
Figure 6:
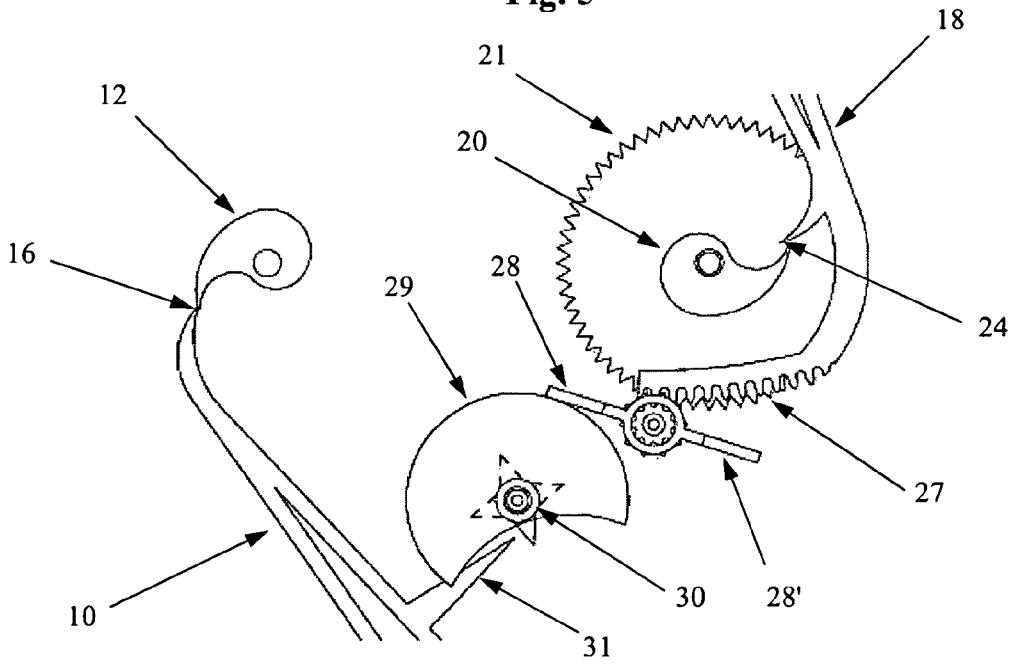
Figure 7:
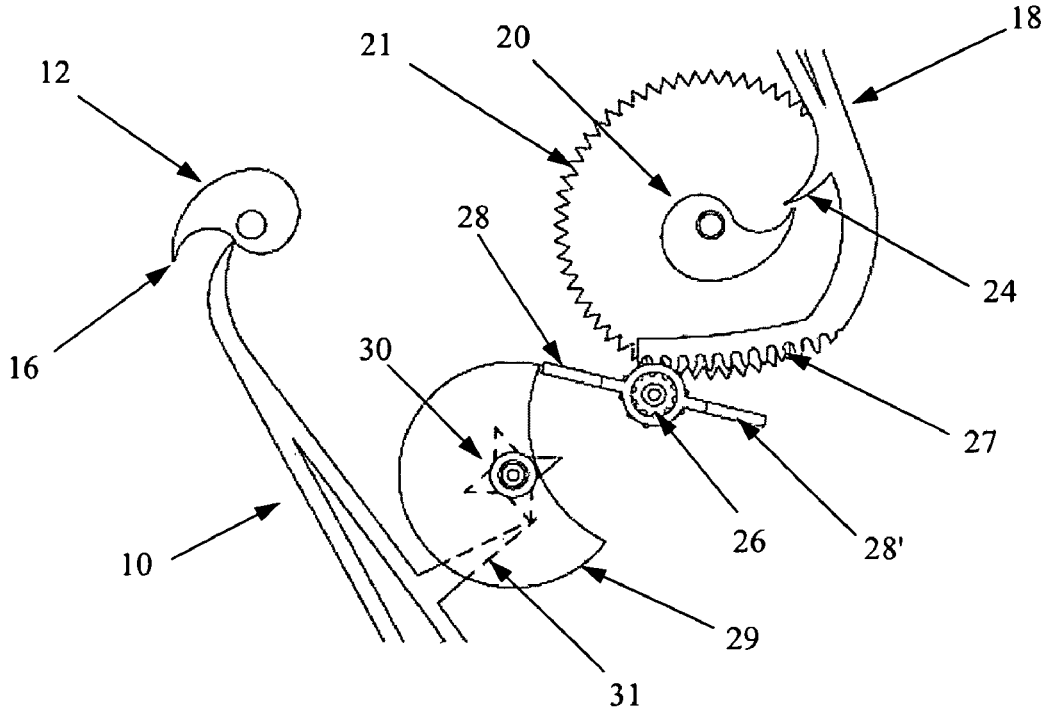
Figure 8:
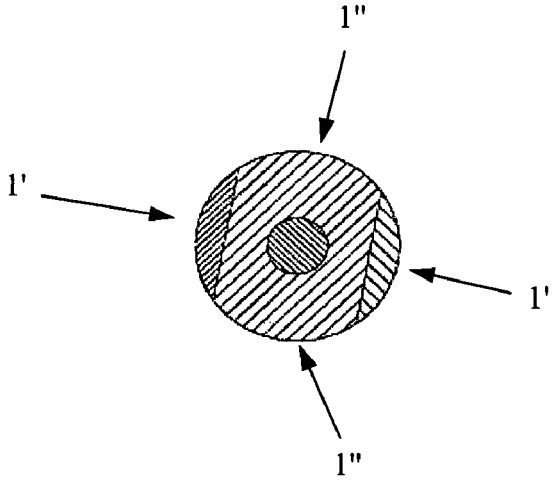
Figure 9:
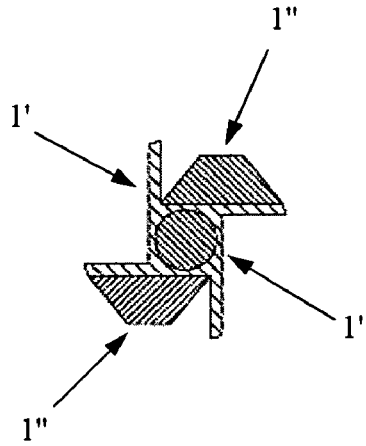
Figure 10:
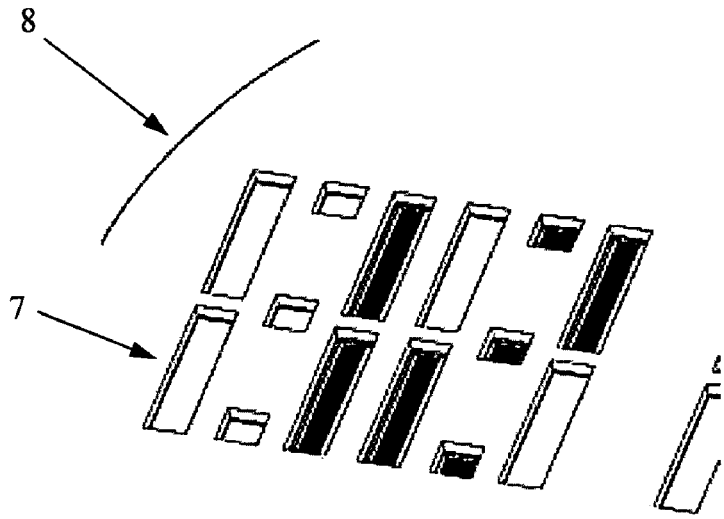
Figure 11:
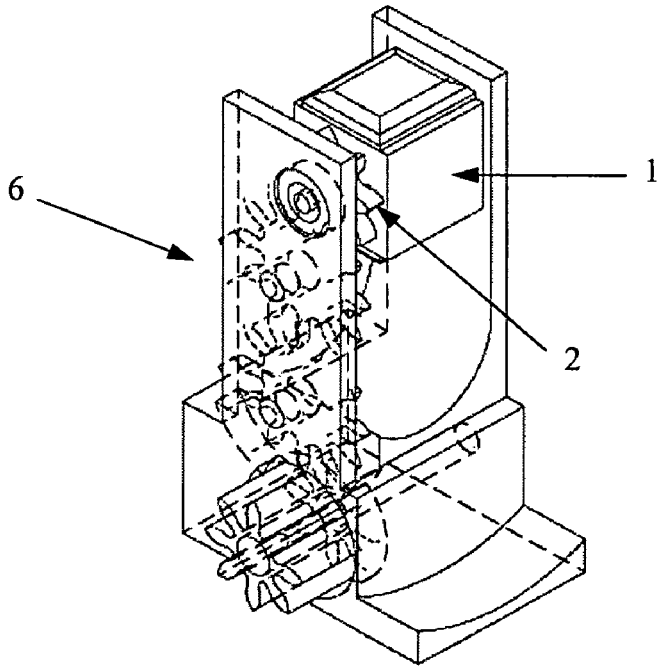

The characteristics of the invention will be made clearer by the description of a number of embodiments, provided solely by way of example and without restrictive intent, with reference to the schematic figures, in which:

FIG. 1 is a perspective view from above of a digit consisting of the seven bars which can pivot about their respective longitudinal shafts according to a first embodiment of the invention, FIG. 2 is a side view of FIG. 1;

FIG. 3 is a schematic view from above of the core of an operating device for pivoting the bars of FIG. 1 by a pulsing method, FIG. 4 is a view from above of FIG. 3, including a first and a second control for correcting the display of the hour digit and the minute digit respectively, FIG. 5 is a detailed view of the operating device including a system for synchronizing the hour display with the minute display, and also for damping the pulses, FIG. 6 is a view of FIG. 5 immediately before the swinging of a first and a second operating member responsible for generating pulses once every minute and once every hour respectively, FIG. 7 is a view of FIG. 5 after the swinging of the first operating member and before the swinging of the second operating member, FIG. 8 and FIG. 9 show a cross section of the bar in a second and a third embodiment respectively, FIG. 10 is a partial view from above of a watch dial showing two mechanical digital display digits, FIG. 11 is a view of a gear train designed to pivot one of the horizontal bars.

In the principal embodiment of the invention, the mechanical digital display is adapted so that it can be incorporated into a wristwatch. This display has four digits, showing respectively tens of hours, hours, tens of minutes and minutes. Each digit consists of a mechanism including seven bars (1), of which four are vertical while the other three, which are shorter, are horizontal.

Each bar (1) has four faces and can pivot about its longitudinal shaft (3). A pinion (2) is placed adjacent to one of the ends of each bar (1) on the longitudinal shaft (3) of the latter. The pinion (2) is fixed to the bar (1) in such a way that the bar can be pivoted when said pinion (2) is driven, so that it can be positioned in different orientations.

Each bar (1) is pivoted by driving the pinion (2) by means of a cam (4). Seven cams (4) are therefore fixed to a shaft (5) so that each of the seven bars (1) can be pivoted. Four of the seven cams (4) are positioned coaxially adjacent to each other on the shaft (5) at one end of the mechanism forming the digit. This shaft (5) is positioned along the length of the mechanism including the seven bars (1) forming the digit (FIG. 2).

Two of the four cams (4) are designed to drive directly the pinion (2) of a first and a second vertical bar (1) respectively, while the other two cams (4) are designed to drive the pinion (2) of the first horizontal bar (1) and of the central horizontal bar (1) respectively, by means of a first and a second pinion (2') mounted on a second shaft (5') (FIGS. 1 and 2), said pinions (2') engaging with a first and a second gear train (6) respectively (FIG. 11).

Three other cams (4) are positioned coaxially adjacent to each other at the other end of the digit on the shaft (5). Two of these three cams (4) are designed to drive directly the pinion (2) of a third and a fourth vertical bar (1) respectively, while the third cam (4) is designed to drive the last horizontal bar (1) by means of a third gear train (6) (FIG. 11).

An operating device, as described below, enables the necessary power to be transmitted to the different cams (4) in the form of pulses, so that the bars (1) can be pivoted through 90° on their longitudinal shafts (3), in order to make another face of each bar, having a different appearance, visible through apertures (7) formed in the dial (8) of the watch (FIG. 10). The display of a figure is achieved as a result of the dissimilarity of the appearance between the different visible faces of the set of bars (1) forming the digit. The pivoting of one or more bars (1) to replace one face with another having a different appearance therefore creates the display of another figure.

The profile of each cam (4) is determined in such a way as to pivot the appropriate bars (1) to display the FIGS. 0 to 9 in succession for the minutes digit, the FIGS. 0 to 5 for the tens of minutes digit, the FIGS. 0 to 9 for the hours digit and the FIGS. 0 to 2 for the tens of hours digit.

Consequently, the profiles of the cams (4) used in the mechanism designed to display, for example, the tens of minutes digit, differ from the profiles of the cams (4) used in the mechanism designed to display the minutes digit, since the pivoting of one or more bars (1) must be carried out in such a way as to display successively only the FIGS. 0 to 5, the pivoting of the bars (1) forming the tens of minutes digit taking place ten times less frequently than that of the bars forming the minutes digit (1).

Each visible face of the bars (1) can be fitted with a plurality of gemstones. For example, a face can be fitted with transparent diamonds only, while the next face can be fitted with black diamonds only. Many different configurations can be provided. However, particular attention will be paid to the choice of coating between the first face of the bar (1) and the face made visible after the rotation of the bar through 90° to provide adequate contrast to facilitate the reading of the display.

The mechanical digital display includes an operating device. This enables the mechanical digital display to be adapted to a base watch movement, of the Valjoux™ type for example.

This device has a first operating member designed, on the one hand, to convert the movement of the seconds wheel of the watch movement to a pulse occurring once every minute, and, on the other hand, to transmit this pulse, by means of a minutes gear train (9), so as to impart a rotary movement to the seven cams (4) of the mechanisms forming the minutes digit and the tens of minutes digit respectively, in order to enable the bars (1) to pivot instantaneously or virtually instantaneously.

A second operating member is designed to convert the movement of the cannon pinion of the watch movement into a pulse occurring once every hour, the pivoting of the bars (1) forming the hours digit and the tens of hours digit being formed on the same principle as that stated above.

The first operating member for the display of the two digits showing tens of minutes and minutes respectively includes a minutes yoke (10) which can pivot on the shaft (11) and a minute snail (12), the latter being fixed to the seconds wheel of the watch movement, the said snail (12) consequently completing one full revolution every minute. One end of the minutes yoke (10) interacts with the periphery of the minute snail (12), while its other end is provided with a hinged point (13) which can drive, by at least one step, a minutes star wheel (14) fixed to a first wheel (15) of the minutes gear train (9).

The profile of the snail (12) is such that a certain amount of mechanical energy can be accumulated constantly and progressively and is transmitted by the minutes yoke (10) to its return spring (not shown). When the stop (16) of the minute snail (12) rides over the end of the yoke (10) (FIG. 6), the energy accumulated in the return spring is transmitted to the first wheel (15) of the minutes gear train (9) by the action of the point (13) on the minutes star wheel (14), the pulse being generated by the pivoting of said yoke (10) on the shaft (11).

This operating member therefore enables the rotary movement of the seconds wheel of the watch movement to be converted into a single pulse having sufficient energy to enable the bars to be pivoted (1) by means of the different gears (6, 9) and the cams (4).

The minutes gear train (9) has a first 90° direction changing gear (17) designed to transmit the pulse by means of other wheel systems (not shown) to the shaft (5) of the minutes and tens of minutes digits respectively. The shafts (5) of the minutes and tens of minutes digits are thus given an axial movement, each of the shafts (5) driving the seven cams (4). Each of the seven cams (4) of each digit is thus given an intermittent rotary movement so that it can pivot one of the bars (1) forming the minutes digit and the tens of minutes digit respectively.

The second operating member for the display of the two digits showing tens of hours and hours respectively includes an hours yoke (18) which can pivot on the shaft (19) and an hour snail (20), the latter being fixed to a 60-tooth star wheel (21) mounted on the cannon pinion of the watch movement, the said snail (20) consequently completing one full revolution every hour.

One end of the hours yoke (18) can drive, by means of a second retractable point (13'), an hours star wheel (22) arranged to engage with a second 90° direction changing gear (23). Said yoke (18) has a projection (24) designed to interact with the periphery of the hours snail (20).

The conversion of the movement of the cannon pinion into a pulse occurring once every hour on the hours star wheel (22) is achieved by the same principle as that described previously. The 90° direction changing gear (23) is designed to transmit the pulse by means of other wheel systems (not shown) to the shafts (5) of the hours digit and the tens of hours digit respectively.

The first and second operating members are connected by a system for synchronizing the pivoting of the two yokes (10, 18), to ensure that the hours and minutes digits are incremented virtually simultaneously, and for damping the pulses generated by said yokes (10, 18).

This system includes a one-way clutch (25) mounted coaxially on a pinion (26), said pinion (26) being designed to be driven by a rack (27) forming an integral part of the hours yoke (10). This clutch (27) is provided, on either side of its center, with two arms (28, 28'), both of which can bear on a part of the periphery of a partial disk (29) resembling a crescent. This partial disk (29) is fixed to a star wheel (30), which can be driven by a point (31) fixed to the minutes yoke (10).

When the system is in the configuration in which the minutes yoke (10) is on the point of pivoting (FIG. 6), the following sequence of movements is initiated:

- the minutes yoke (10) pivots, thus driving, on the one hand, the minutes star wheel (14) which drives the minutes gear train (9) by means of the first wheel (15), and, on the other hand, rotating the partial disk (29) by the action of the point (31) of the yoke (10) on the star wheel (30),
- the rotation of the partial disk (29) disengages the one-way clutch (25) by disengaging one of its arms (28, 28') from said partial disk (29) (FIG. 7),
- the rack (27) can thus move and drive the pinion (26), the movement of said rack (27) causing, on the one hand, the pivoting of the hours yoke (18) on the shaft (19), thus driving the hours star wheel (22) by at least one step, and, on the other hand, the positioning of the other of the two arms (28, 28') of the clutch (25) on a portion of the periphery of the partial disk (29) (FIG. 5).

One of the two arms (28, 28') of the clutch (25) therefore remains in contact at all times with this partial disk (29) for an hour, thus damping the 59 jumps of the minutes yoke (10) occurring during this period.

In this embodiment, each face of each bar (1) has two distinct patterns alternating with each other.

A first minutes correction control (32), which can be actuated by a push button (33), is arranged so as to act simultaneously on the minutes star wheel (13) and on the 60-tooth star wheel (21). A second hours correction control (34), which can be actuated by a push button (35), is arranged so as to act directly on the hours star wheel (22) to increment the hours by at least one unit (FIG. 4).

The minutes digit is corrected initially by pressing the button (33) for a maximum of 59 times. The hours correction is carried out by pressing the button (35) for a maximum of 11 times. The retractable points (13, 13') of the two yokes (10, 18) are retracted during the fast correction, to enable the minutes star wheel (14) and the hours star wheel (22) to rotate.

The use of a damping mechanism can be considered in order to avoid the unfavorable dynamic effects on the operating mechanism, the synchronization and the drive system.

In a second embodiment shown in FIG. 8, the bars (1) are cylindrical and have four strips (1', 1") along the whole of their length. Two of these strips have an identical pattern, while the other two are identical to each other but different from the first two. The strips are arranged alternately, so that a different pattern appears through the apertures (7) in the dial (8) of the watch after each pulse produced by the operating device.

In another embodiment, as shown in FIG. 9, each of the bars (1) can resemble a shape whose cross section has four flat surfaces having a tangential projection. This tangential projection enables the space between the segments to be reduced and thus improves the reading of the figure. Gemstones can be placed alternately on two of the four flat surfaces.

Clearly, the invention is not limited to the embodiments described above, but includes all variant embodiments. For example, the minute snail (12) can be replaced with a cam having N apices, said cam completing one revolution in N minutes.

The invention claimed is:

1. A mechanical digital display having at least one digit consisting of at least seven segments (1) for displaying alphanumeric characters, each segment (1) being a body in the form of a bar (1) which can pivot on its longitudinal shaft (3), each of the said bars (1) having at least two areas resembling a first and a second strip (1', 1") having different appearances, the said strips (1', 1") being arranged along the length of the bar (1) in such a way that the orientation of the bar (1) by a rotation about its longitudinal shaft (3) enables either the first or the second strip (1', 1") to be made visible, the display of an alphanumeric character being achieved as a result of the dissimilarity of appearance between the first and the second strip (1, 1") of the set of bars (1), the pivoting of one or more bars (1) to replace the first strip (1') with the second strip (1") or vice versa generating the display of different alphanumeric characters, characterized in that at least one pinion (2), fixed to the bar (1), is positioned around each longitudinal shaft (3) adjacent to at least one of the ends of said bar (1), the bars (1) being pivoted by means of cams (4) interacting directly or indirectly with each pinion (2), characterized in that the mechanical digital display comprises an operating device designed to transmit a rotary movement to said cams (4) by pulses so that the pivoting of the bars (1) takes place instantaneously or virtually instantaneously.

2. The mechanical digital display as claimed in claim 1, characterized in that the bars (1) are regular prisms having four faces, each of the faces showing the first and the second strip (1', 1") alternately, each pulse of the operating device enabling the bar (1) to be pivoted through 90° about its longitudinal shaft (3).

3. The mechanical digital display as claimed in claim 1, characterized in that the bars (1) are cylindrical.

4. The mechanical digital display as claimed in claim 1, characterized in that some of the bars (1) are shorter.

5. The mechanical digital display as claimed in claim 1, characterized in that the bars are cylindrical and some of the bars (1) are shorter.

6. The mechanical digital display as claimed in claim 1, characterized in that it has four digits indicating the tens of hours, hours, tens of minutes and minutes respectively.

7. The mechanical digital display as claimed in claim 5, characterized in that it has four digits indicating the tens of hours, hours, tens of minutes and minutes respectively.

* * * * *